US008068074B2

(12) United States Patent
Kawabe

(10) Patent No.: US 8,068,074 B2
(45) Date of Patent: Nov. 29, 2011

(54) PIXEL DRIVE CIRCUIT FOR ELECTROLUMINESCENT ELEMENT

(75) Inventor: Kazuyoshi Kawabe, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 656 days.

(21) Appl. No.: 12/241,360

(22) Filed: Sep. 30, 2008

(65) Prior Publication Data

US 2009/0096723 A1 Apr. 16, 2009

(30) Foreign Application Priority Data

Oct. 10, 2007 (JP) ..... 2007-263904

(51) Int. Cl.
*G09G 3/30* (2006.01)

(52) U.S. Cl. ..... 345/77; 345/690

(58) Field of Classification Search ..... 345/77, 345/80, 84, 690; 257/82
See application file for complete search history.

(56) References Cited

U.S. PATENT DOCUMENTS

| | | | | |
|---|---|---|---|---|
| 4,645,948 | A * | 2/1987 | Morris et al. | 327/538 |
| 7,106,006 | B2 * | 9/2006 | Koyama | 315/169.3 |
| 2005/0264180 | A1 * | 12/2005 | Kato | 313/503 |
| 2006/0022206 | A1 * | 2/2006 | Hayakawa et al. | 257/82 |
| 2008/0012801 | A1 * | 1/2008 | Kimura et al. | 345/80 |
| 2008/0018570 | A1 * | 1/2008 | Gerets | 345/84 |

FOREIGN PATENT DOCUMENTS

WO 2006/020511 2/2006

* cited by examiner

*Primary Examiner* — Amr Awad
*Assistant Examiner* — Bassam Noaman
(74) *Attorney, Agent, or Firm* — Morgan, Lewis & Bockius LLP

(57) ABSTRACT

A pixel circuit including a storage capacitor to which data is written including a black level; a second driving transistor supplies a drive current corresponding to data written to the storage capacitor to a second organic electroluminescence element; a first driving transistor supplies to a first organic electroluminescence element drive current that reflects brightness degradation or current degradation in the second organic electroluminescence element, wherein the second driving transistor supplies a predetermined drive current to the second organic electroluminescence element including data of the black level; and the drive voltage of the first driving transistor is set to a voltage reflecting the brightness degradation or current degradation in the second organic electroluminescence element.

2 Claims, 7 Drawing Sheets

PIXEL DRIVE CIRCUIT FOR ELECTROLUMINESCENT ELEMENT

CROSS REFERENCE TO RELATED APPLICATION

This application claims priority of Japanese Patent Application No. 2007-263904 filed Oct. 10, 2007 which is incorporated herein by reference in its entirety.

FIELD OF THE INVENTION

The present invention relates to a pixel circuit which drives an organic electroluminescence (hereinafter "EL") element.

BACKGROUND OF THE INVENTION

Liquid crystal display devices are widely in use as a thin display device in the related art. In the liquid crystal display device, light from a backlight is controlled by liquid crystal to realize a display. Because of this, display of a complete black level is difficult, and realization of a sufficiently high contrast is difficult.

On the other hand, in an organic EL display which is self-emissive, light emission and non-emission is controlled for each pixel depending on the content of the image. Because of this, a black level in which there is no light emission can be represented, and thus a high contrast and a high image quality can be achieved.

In an organic EL display, because the light emission intensity and light emission frequency differ for each pixel, the degree of degradation differs between a pixel in which bright light is frequently emitted and a pixel in which light is rarely emitted. Image burn-in tends to occur in the pixel in which bright light is frequently emitted.

SUMMARY OF THE INVENTION

According to one aspect of the present invention, there is provided a pixel circuit comprising:

a first organic electroluminescence element which contributes to light emission;

a second organic electroluminescence element which does not contribute to light emission;

a storage capacitor to which data is written including a black level;

a second driving transistor which supplies a drive current corresponding to data written to the storage capacitor to the second organic electroluminescence element;

a first driving transistor which supplies, to the first organic electroluminescence element drive current which corresponds to a drive voltage that reflects brightness degradation or current degradation in the second organic electroluminescence element, wherein the second driving transistor supplies a predetermined drive current to the second organic electroluminescence element including data of the black level; and means for setting the drive voltage of the first driving transistor to a voltage reflecting the brightness degradation or current degradation in the second organic electroluminescence element.

According to another aspect of the present invention, it is preferable that, in the pixel circuit, a drive voltage which corresponds to data written to the storage capacitor is supplied to a gate of the second driving transistor, and the voltage at the intermediate point between the second driving transistor and the second organic electroluminescence element is supplied to a gate of the first driving transistor.

According to another aspect of the present invention, it is preferable that, in the pixel circuit, one terminal of the storage capacitor is connected to a power supply line and the other terminal of the storage capacitor is connected to the gate of the second driving transistor, a source of the first driving transistor and a source of the second driving transistor are connected to the power supply line, and a drain of the first driving transistor is connected to the first organic electroluminescence element and a drain of the second driving transistor is connected to the second organic electroluminescence element.

According to another aspect of the present invention, it is preferable that, in the pixel circuit, one terminal of the storage capacitor is connected to a second power supply line and the other terminal of the storage capacitor is connected to the gate of the second driving transistor, a source of the first driving transistor is connected to a first power supply line, a source of the second driving transistor is connected to the second power supply line, a drain of the first driving transistor is connected to the first organic electroluminescence element, and a drain of the second driving transistor is connected to the second organic electroluminescence element.

According to the present invention, a slight current is supplied to the second organic electroluminescence element which does not contribute to light emission even for a black display. With this structure, a voltage reflecting a voltage drop which changes according to the degradation of the second organic electroluminescence element can be obtained, and the first driving transistor supplies a drive current to the first organic electroluminescence element which contributes to the light emission based on the obtained voltage. Therefore, a drive current for the first organic electroluminescence element which contributes to the light emission can be obtained according to the degree of driving of the pixel, and thus the change of light emission due to degradation of the first organic electroluminescence element can be compensated for.

BRIEF DESCRIPTION OF THE DRAWINGS

Preferred embodiments of the present invention will be described in detail by reference to the drawings, wherein.

DETAILED DESCRIPTION OF THE INVENTION

Figure 1:
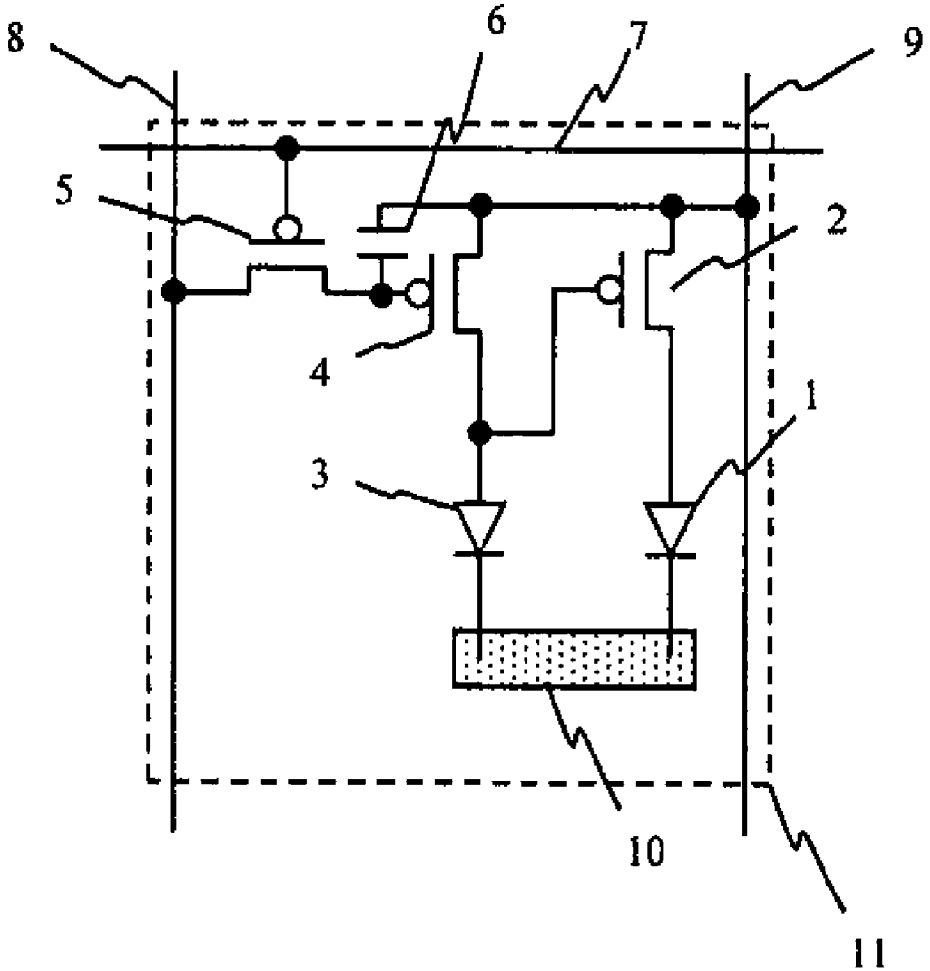
FIG. 1 is a diagram showing a structure of a pixel circuit in a preferred embodiment of the present invention.

Preferred embodiments of the present invention will now be described with reference to the drawings. FIG. 1 shows a pixel 11 including three p-type transistors 2, 4, and 5, a storage capacitor 6, and two organic EL elements 1 and 3.

A cathode of a first organic EL element 1 which contributes to light emission and a cathode of a second organic EL element 3 which is light-shielded or the like and does not contribute to light emission are connected to a cathode electrode 10 to which a power supply potential VSS is applied and which is common to all pixels. An anode of the first organic EL element 1 is connected to a drain terminal of the first driving transistor 2 and an anode of the second organic EL element 3 is connected to a drain terminal of the second driving transistor 4 and to a gate terminal of the first driving transistor 2. Source terminals of the first driving transistor 2 and the second driving transistor 4 are connected to a power supply line 9 to which a power supply voltage VDD is applied and which is common to all pixels. On a gate terminal of the second driving transistor 4, a second terminal of the storage capacitor 6 having a first terminal connected to the power supply line 9 and a source terminal of a gate transistor 5 are connected. A gate terminal of the gate transistor 5 is connected to a gate line 7 and a drain terminal is connected to a data line 8.

When the gate line 7 is selected (in the illustrated case, when the gate line 7 is set to Low), a digital signal which is High or Low and supplied to the data line 8 is supplied to the gate terminal of the second driving transistor 4 and is written to the storage capacitor 6.

When the data is Low, the second driving transistor 4 is switched ON, a current flows through the second organic EL element 3, and the anode potential of the second organic EL element 3 reaches VDD. As a result, the first driving transistor 2 is switched OFF, no current flows through the first organic EL element 1, and no light is emitted. In other words, the first organic EL element 1 and the second organic EL element 3 complementarily operate such as, for example, the first organic EL element 1 not emitting light and the second organic EL element 3 emitting light. Then, the gate line 7 is set to a non-selection state, but the complementary state is continued until the gate line 7 is next selected and data is written.

When data of High is supplied to the data line 8, because the current flowing through the second driving transistor 4 is reduced because of the High potential written to the storage capacitor 6, the anode potential of the second organic EL element 3 is reduced. If the anode potential of the second organic EL element 3 is lower than a voltage necessary for the first driving transistor 2 to be switched ON, the first driving transistor 2 is switched ON, a current flows through the first organic EL element 1, and light is emitted. In this case also, the first organic EL element 1 and the second organic EL element 3 are in the complementary relationship such as the first organic EL element 1 emitting light and the second organic EL element 3 not emitting light. Even when the gate line 7 is set to the non-selection state, the complementary state is continued until the gate line 7 is next selected.

As the High potential written to the storage capacitor 6, a value is set so that the second driving transistor 4 permits a certain amount of current to flow. Because of this, in reality, light of a very low intensity is emitted from the second organic EL element 3. However, because the current flowing through the second organic EL element 3 is smaller compared to the case in which the Low potential is written to the storage capacitor 6, this light emission can be considered a non-emission.

Figure 2B:
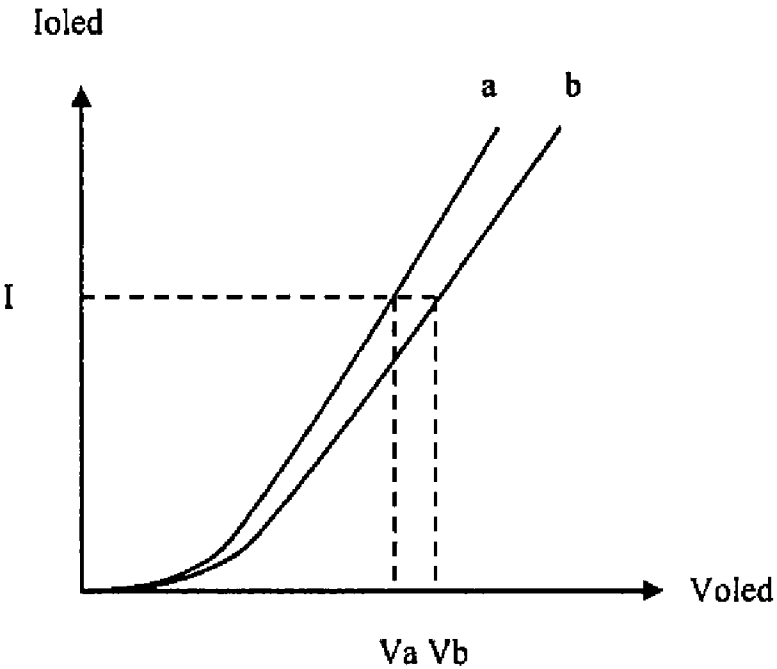
FIG. 2B is a diagram showing influence of degradation of the organic EL element on an I-V characteristic.
Figure 2A:
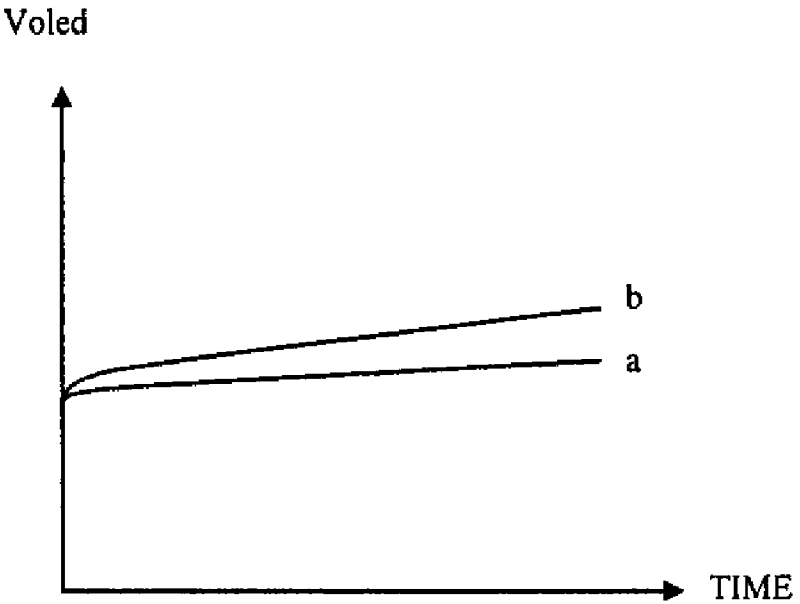
FIG. 2A is a diagram showing influence of degradation of the organic EL element on an anode voltage.

FIG. 2 shows application of the same constant current stress to similar organic EL elements a and b, with the application frequency being b>a. FIG. 2A shows a change of the drive voltage (voltage necessary for obtaining the same current) with respect to time and FIG. 2B shows changes in I-V characteristics (relationship between current and voltage) of the organic EL elements a and b after a predetermined period of time has elapsed. Because the application frequency of the constant current stress is greater for the organic EL element b, in general, the organic EL element b degrades faster, and the drive voltage for achieving the constant current to flow is increased. Thus, the I-V characteristic shifts to the right as time elapses, and the organic EL element b is degraded toward a characteristic which permits less current to flow. This degradation process similarly applies to both the first organic EL element 1 and the second organic EL element 3 of FIG. 1. In particular, the degradation of the first organic EL element 1 appears in the display as burn-in.

As can be understood from FIG. 2B, when the same current I is supplied, the drive voltages Va and Vb appearing in the organic EL elements a and b having different degradations differ from each other, and the drive voltage Vb of the organic EL element b with a greater degradation becomes greater than the drive voltage Va. Therefore, by applying the same current and reading the difference in drive voltages, it is possible to detect a difference in the degradation.

In the pixel 11 of FIG. 1, the second driving transistor 4 supplies a constant current of a certain amount to the second organic EL element 3 when light is emitted from the first organic EL element 1. In the pixel 11 of FIG. 1, because the drive voltage of the second organic EL element 3 is applied to the gate potential of the first driving transistor 2 due to the constant current, the degradation of the second organic EL element 3 can be reflected in the gate potential of the first driving transistor 2.

Figure 3:
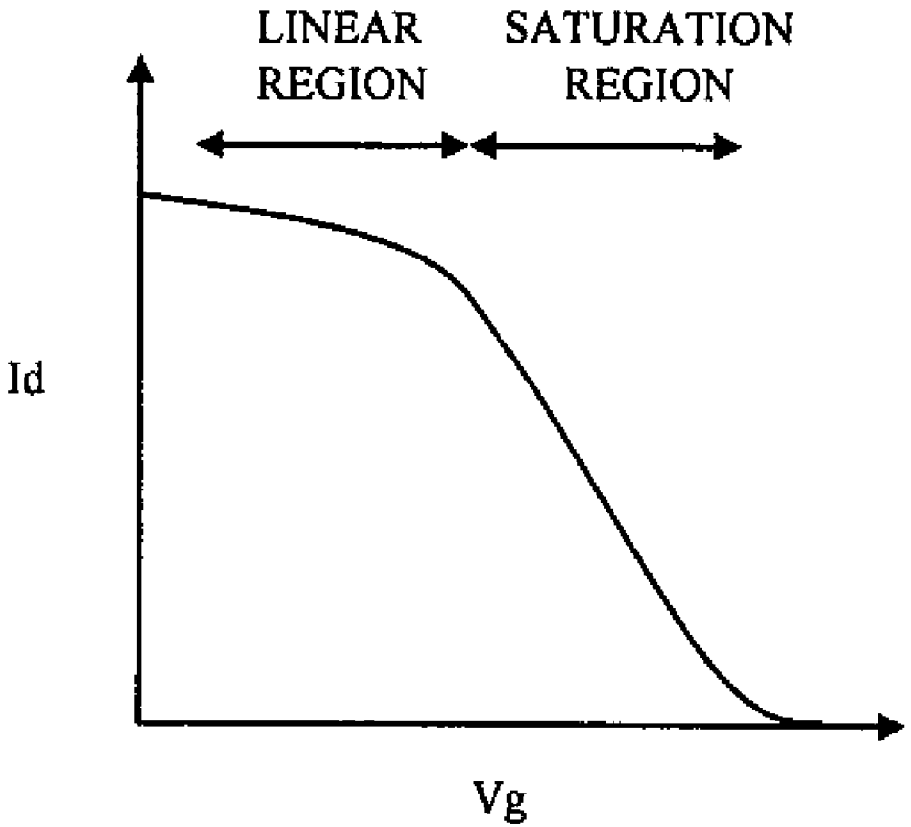
FIG. 3 is a diagram showing a relationship between a gate voltage and a drain current of a transistor.

FIG. 3 shows a relationship between a gate voltage Vg and a drain current Id of a p-type transistor. In the relationship, there are a saturation region in which the drain current Id rapidly changes with a change in the gate potential Vg and a linear region in which the drain current Id does not change as rapidly. In either case, the drain current Id can be changed by changing the gate potential Vg. In other words, a control is applied such that the drain current is reduced because the gate potential Vg of the first driving transistor 2 is increased when the degradation of the second organic EL element 3 is great, and the drain current is increased because the gate potential is reduced when the degradation is small.

Referring again to the operation of the pixel 11 shown in FIG. 1, when no light is emitted from the first organic EL element 1, a current flows through the second organic EL element 3, and the degradation of the second organic EL element 3 progresses. When, on the other hand, light is emitted from the first organic EL element 1, although a current flows through the second organic EL element 3, the amount of current is smaller compared to the case when no light is emitted from the first organic EL element 1, and the progress of the degradation is slower. Therefore, in a pixel in which the first organic EL element 1 does not emit light, the gate potential of the first driving transistor 2 is gradually increased depending on the degree of progress of the degradation of the second organic EL element 3, and the light emission in the pixel is reduced. In a pixel in which light continues to be emitted from the first organic EL element 1, the second organic EL element 3 is not degraded. However, even though the gate potential is the same, the emission efficiency of the first organic EL element 1 itself is reduced due to degradation of the first organic EL element 1, and thus light emission is reduced in the pixel. With the pixel 11 of FIG. 1, because light emission in the pixel in which no light is emitted and light emission in the pixel in which light continues to be emitted are reduced in a similar manner, the difference in the degradation due to the difference in the light emission frequency becomes less apparent. In other words, the burn-in can be effectively inhibited. When light emission is started in a pixel in which light has not been emitted, the progress of the degradation of the second organic EL element 3 is stopped. Because of this, the gate potential of the first driving transistor 2 is not increased. However, because the first organic EL element 1 itself starts to be degraded, the light emission is reduced in a similar manner. In this manner, regardless of whether or not light is emitted from the first organic EL element 1, because the second organic EL element 3 which always operates in a complementary manner and records the degradation in a similar manner is provided, the burn-in can be reduced by controlling the first driving transistor 2.

When the structure of FIG. 1 is to be digitally operated and a multiple grayscale is to be achieved using a plurality of sub-frames or sub-pixels, the correction of the peak light emission intensity acts similarly in all grayscales, and thus the burn-in can be inhibited in all grayscales. The burn-in can also be inhibited when an analog voltage is supplied to the data line 8 and the second driving transistor is operated with a constant current.

More specifically, an analog voltage can be written to the storage capacitor 6, the second driving transistor 4 can be controlled, and the anode potential of the second organic EL element 3 can be controlled. When white is to be displayed, a small current can be applied to the second organic EL element 3 so that the gate potential of the first driving transistor 2 is reduced and bright light is emitted from the first organic EL element 1. In this case also, the complementary relationship is maintained such that bright light is emitted from the first organic EL element 1 and dim light is emitted from the second organic EL element 3. When black is to be displayed, on the other hand, current can be permitted to flow through the second organic EL element 3 so that the gate potential of the first driving transistor 2 is increased and dim light is emitted from the first organic EL element. Similar to the above, the relationship between the light emission intensities in the first organic EL element 1 and in the second organic EL element is complementary. When an intermediate brightness is to be output, the complementary relationship in the light emission intensities is maintained. In the case of the analog driving, the circuit operates in a relationship to maintain the total of the light emission intensities, rather than the complementary relationship.

Figure 4:
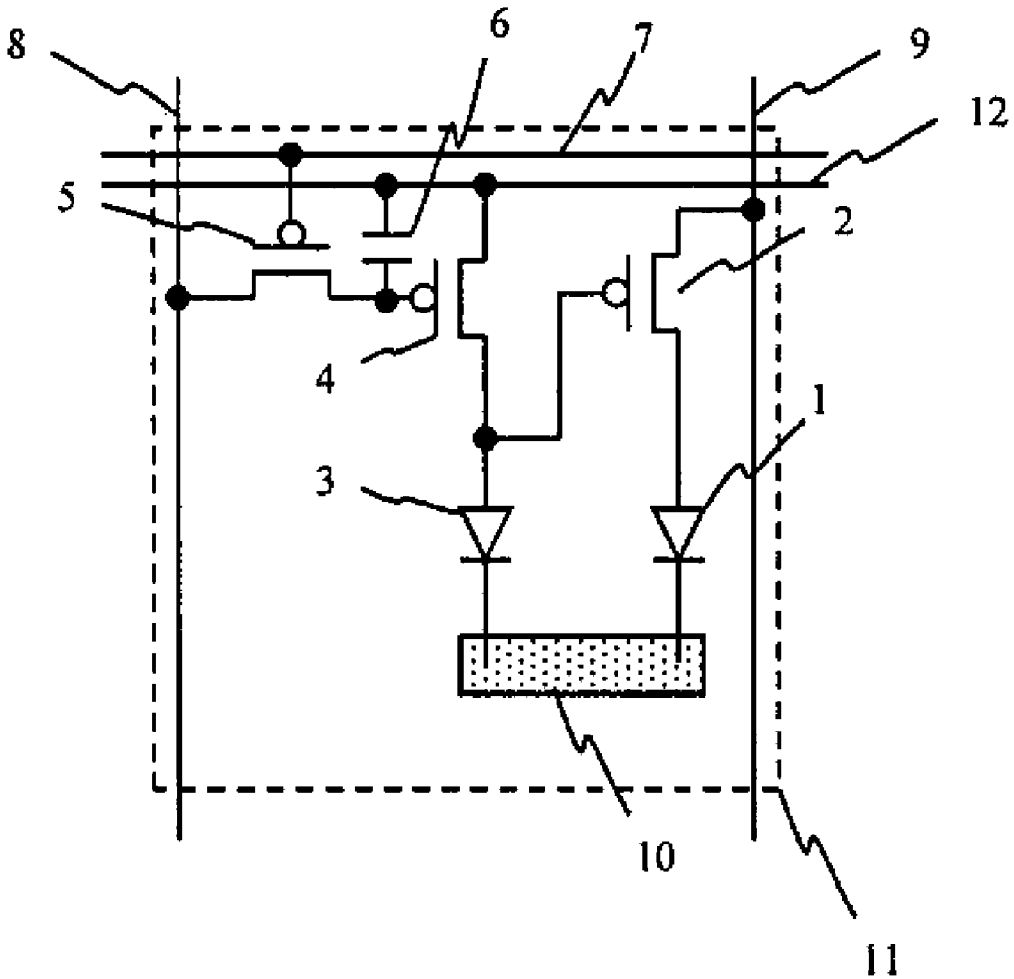
FIG. 4 is a diagram showing a structure of a pixel circuit according to another preferred embodiment of the present invention.

When it is difficult to set the gate potential of the first driving transistor 2 to a suitable value because the cathode electrode 10 is common to the pixels, a second power supply line 12 can be provided as shown in FIG. 4 and can be connected to the source terminal of the second driving transistor 4 so that separate power supply voltages can be set for the source terminals of the second driving transistor 4 and the first driving transistor 2. With this structure, the voltage value of the second power supply line 12 can be freely selected. Thus, it is possible to easily set the anode potential of the second organic EL element 3 when data of Low is written to the storage capacitor 6 and the second driving transistor 4 is switched ON to a potential to switch the first driving transistor 2 OFF and easily set the anode potential of the second organic EL element 3 when a voltage of a predetermined grayscale is written to the storage capacitor 6 and the second driving transistor 4 is slightly switched ON to a potential which permits the first driving transistor 2 to supply a current corresponding to the data.

Figure 5:
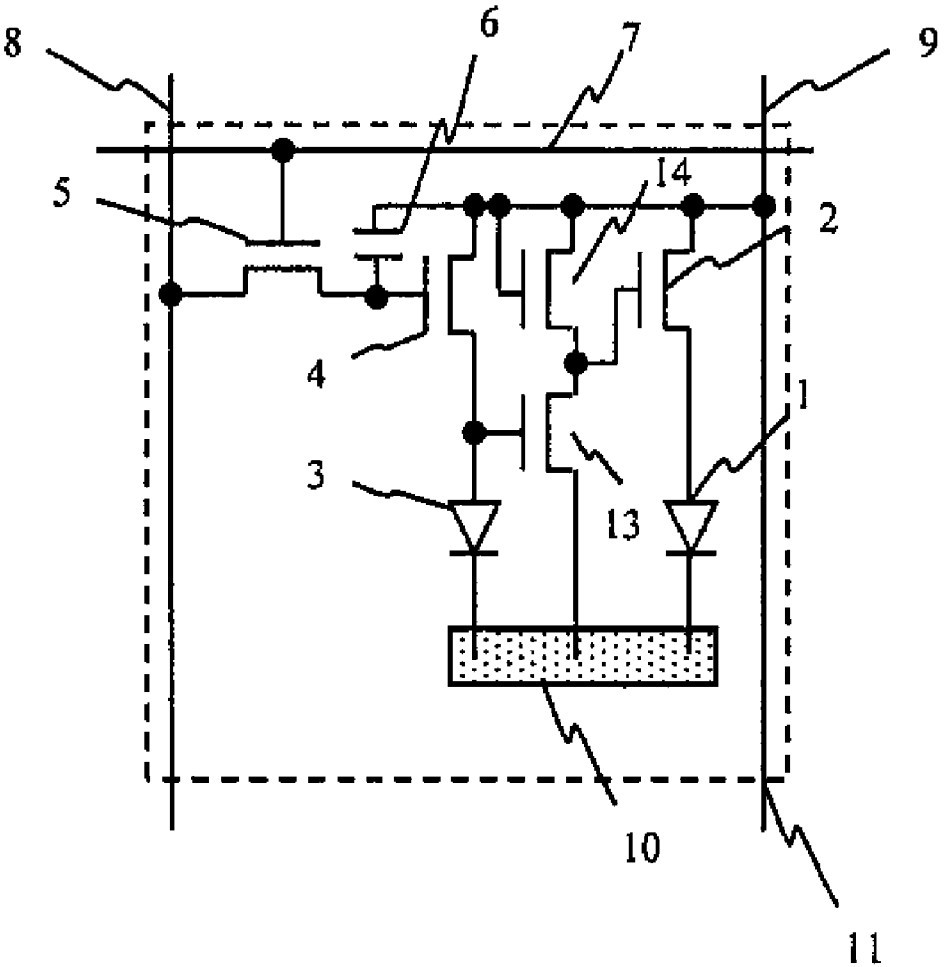
FIG. 5 is a diagram showing a structure of a pixel circuit according to another preferred embodiment of the present invention.
Figure 6:
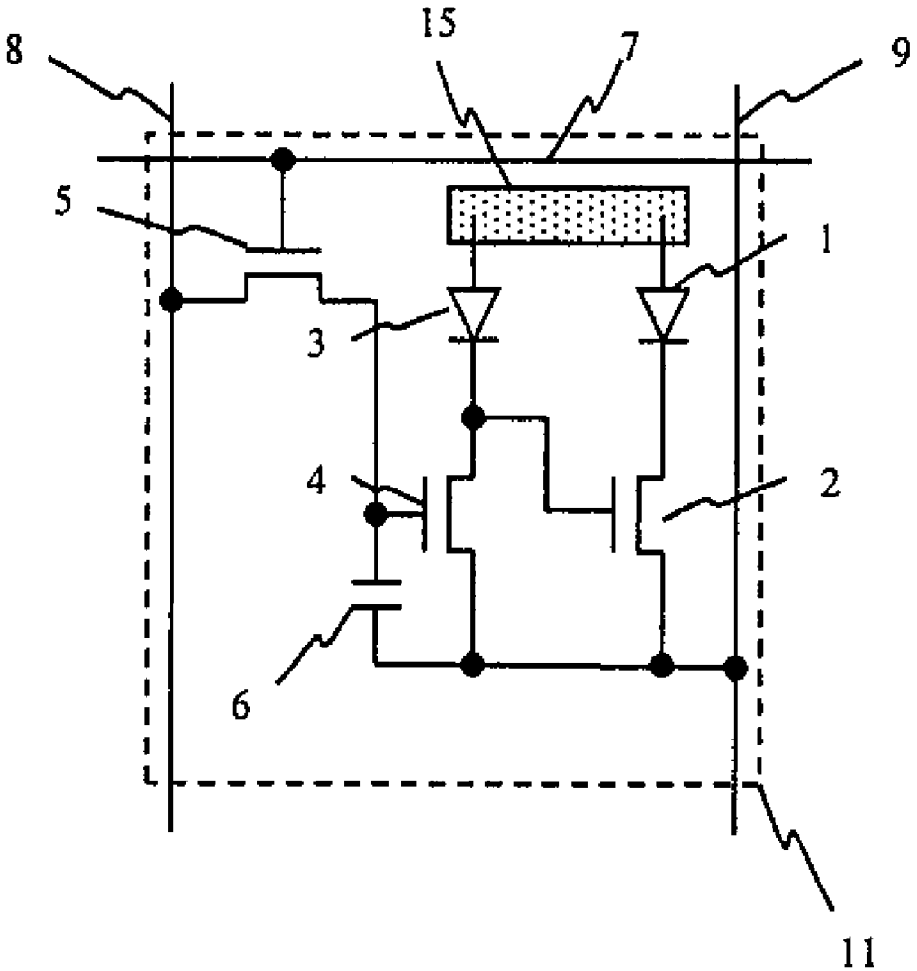
FIG. 6 is a diagram showing a structure of a pixel circuit according to yet another preferred embodiment of the present invention.

When an N-type transistor is to be used, unlike in FIG. 1, the pixel 11 can be constructed, for example, as shown in FIGS. 5 and 6. In FIG. 5, a diode transistor 14 and an off-transistor 13 are connected in series between the power supply line 9 and the cathode electrode 10, and a connection point between the diode transistor 14 and the off-transistor 13 is connected to the gate terminal of the first driving transistor 2. With this structure, when the data is High, the second driving transistor 4 is switched ON, the off-transistor 13 is switched ON, and the first driving transistor 2 is switched OFF. When, on the other hand, the data is Low, the second driving transistor 4 supplies a slight current, and thus the off-transistor 13 remains in the OFF state and the first driving transistor 2 supplies a current. An analog driving according to data is also possible, and, similar to FIG. 4, the upper sides of the storage capacitor 6, the second driving transistor 4, and the diode transistor 14 can be connected to the second power supply line 12. In this manner, in the example configuration of FIG. 5 also, an operation to complementarily emit light from the first organic EL element 1 and the second organic EL element 3 is realized.

In the example structure of FIG. 6, the anodes of the first organic EL element 1 and the second organic EL element 3 are set as an anode electrode 15 common to all pixels, VDD is supplied, the drain terminal of the first driving transistor 2 is connected to the cathode of the first organic EL element 1, and the drain terminal of the second driving transistor 4 and the gate terminal of the first driving transistor 2 are connected to the cathode of the second organic EL element 3. The source terminals of the first driving transistor 2 and the second driving transistor 4 and one terminal of the storage capacitor 6 are connected to the power supply line 9 to which VSS is supplied, and the other terminal of the storage capacitor 6 is connected to the gate terminal of the second driving transistor 4 and the source terminal of the gate transistor 5. Because of this structure, the complementary operation of the first organic EL element 1 and the second organic EL element 3 is realized.

In this manner, even when an N-type transistor such as amorphous silicon is used, the burn-in can be similarly corrected and effectively inhibited.

Figure 7:
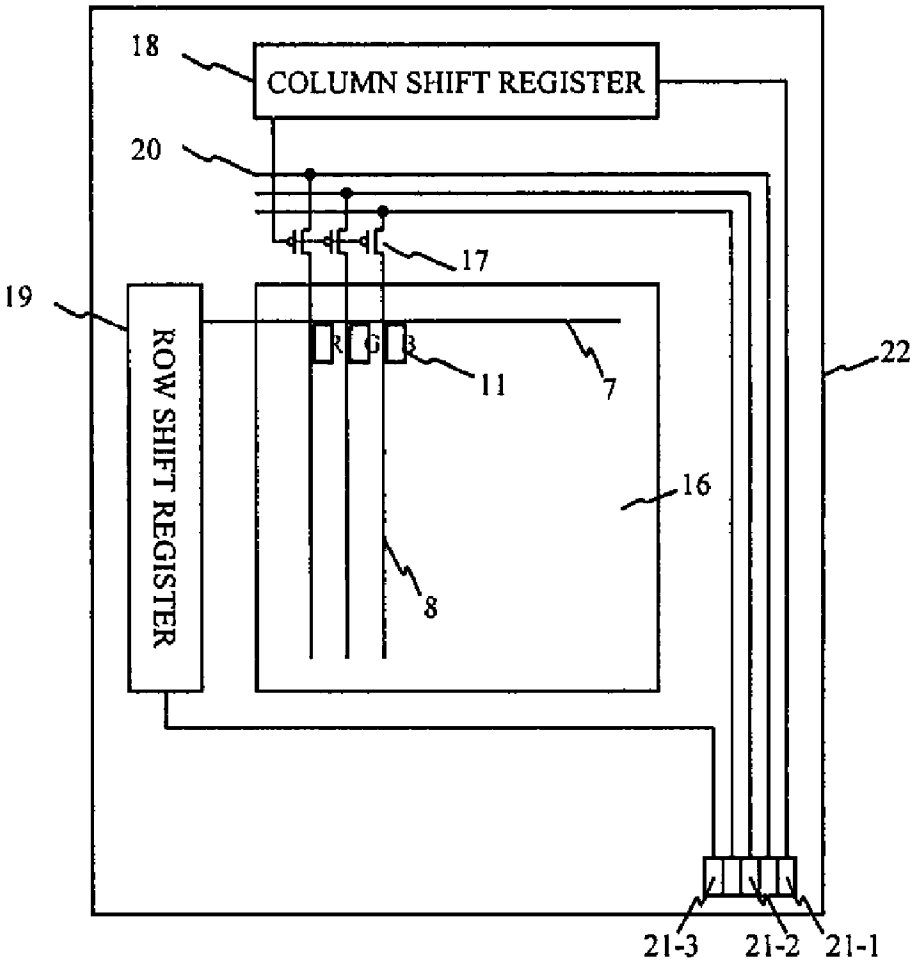
FIG. 7 is a diagram showing an overall structure of a display panel.

FIG. 7 shows an overall structure of an organic EL panel 22. In a display array 16, pixels 11 are placed in a matrix form. A data line 8 is provided corresponding to each column of pixels, and a bus switch 17 which connects each data line 8 to a data bus 20 of each color is provided.

Bus switches 17 are sequentially selected by a column shift register 18 so that the data line 8 and the data bus 20 are connected and data of the colors are sequentially supplied to the data lines 8. Similarly, by sequentially selecting the gate lines 7 with a row shift register 19, data on the data line 8 is supplied to the pixels 11 of the corresponding row. A control signal and data to the column shift register 18, the row shift register 19, and the data bus 20 are input through input pads 21 (21-1~21-3).

When the row shift register 19 selects a gate line 7 of a certain line with a control signal which is input from the input pad 21-3, the column shift register sequentially selects the bus switches 17 from the left to the right, to sequentially connect the data lines 8 and the data buses 20. At the same time, image data of R, G, or B which is input from the input pad 21-2 is supplied to the selected data line 8, data of each of R, G, and B is written to the pixel 11, and light emission intensity is controlled digitally or in an analog manner using sub-frames or sub-pixels according to the data. The illustrated example of FIG. 7 shows a structure in which the pixel 11, the column shift register 18, the row shift register 19, and the bus switch 17 are formed on the same substrate and data is written in units of pixels. Alternatively, a configuration can be employed in which the column shift register is provided in a driver IC or the like and externally equipped on the organic EL panel 22, and data is written to the data lines 8 in units of lines.

In the pixel 11, with the normal active matrix driving as described, the two organic EL elements provided in the pixel 11 operate in a complementary manner, and a correction corresponding to the organic EL element is automatically executed. Because of this structure, there is no need to provide an additional circuit externally, and such a structure can be achieved with a low cost.

The invention has been described in detail with particular reference to certain preferred embodiments thereof, but it will be understood that variations and modifications can be effected within the spirit and scope of the invention.

PARTS LIST

1 organic EL elements
2 first driving transistor
3 organic EL element
4 second driving transistor
5 gate transistor
6 storage capacitor
7 gate line
8 data line
9 power supply line
10 cathode electrode
11 pixel
12 second power supply line
13 off-transistor
14 diode transistor
15 anode electrode
16 display array
17 bus switches
18 column shift register
19 row shift register
20 data bus
21 input pads
22 panel

The invention claimed is:

1. A pixel circuit comprising:

a first organic electroluminescence element which contributes to light emission;

a second organic electroluminescence element which does not contribute to light emission; a storage capacitor to which data is written including a black level;

a second driving transistor which supplies a drive current corresponding to data written to the storage capacitor to the second organic electroluminescence element;

a first driving transistor which supplies, to the first organic electroluminescence element drive current which corresponds to a drive voltage that reflects brightness degradation or current degradation in the second organic electroluminescence element, the second driving transistor supplying a predetermined drive current to the second organic electroluminescence element including data of the black level; and means for setting the drive voltage of the first driving transistor to a voltage reflecting the brightness degradation or current degradation in the second organic electroluminescence element, wherein:

a drive voltage which corresponds to data written to the storage capacitor is supplied to a gate of the second driving transistor, and the voltage at the intermediate point between the second driving transistor and the second organic electroluminescence element is supplied to a gate of the first driving transistor, and wherein:

one terminal of the storage capacitor is connected to a power supply line and the other terminal of the storage capacitor is connected to the gate of the second driving transistor, a source of the first driving transistor and a source of the second driving transistor are connected to the power supply line, a drain of the first driving transistor is connected to the first organic electroluminescence element, and a drain of the second driving transistor is connected to the second organic electroluminescence element.

2. A pixel circuit comprising:

a first organic electroluminescence element which contributes to light emission;

a second organic electroluminescence element which does not contribute to light emission; a storage capacitor to which data is written including a black level;

a second driving transistor which supplies a drive current corresponding to data written to the storage capacitor to the second organic electroluminescence element;

a first driving transistor which supplies, to the first organic electroluminescence element drive current which corresponds to a drive voltage that reflects brightness degradation or current degradation in the second organic electroluminescence element, the second driving transistor supplying a predetermined drive current to the second organic electroluminescence element including data of the black level; and means for setting the drive voltage of the first driving transistor to a voltage reflecting the brightness degradation or current degradation in the second organic electroluminescence element, wherein:

a drive voltage which corresponds to data written to the storage capacitor is supplied to a gate of the second driving transistor, and the voltage at the intermediate point between the second driving transistor and the second organic electroluminescence element is supplied to a gate of the first driving transistor, and wherein:

one terminal of the storage capacitor is connected to a second power supply line and the other terminal of the storage capacitor is connected to the gate of the second driving transistor, a source of the first driving transistor is connected to a first power supply line, a source of the second driving transistor is connected to the second power supply line, a drain of the first driving transistor is connected to the first organic electroluminescence element, and a drain of the second driving transistor is connected to the second organic electroluminescence element.

* * * * *